US005992471A

United States Patent [19]

Chung

[11] Patent Number: 5,992,471

[45] Date of Patent: Nov. 30, 1999

[54] REMOVAL DEVICE FOR A WASTE WEFT

[75] Inventor: Won Ki Chung, Daegu, Rep. of Korea

[73] Assignee: Jet Engineering Co., Ltd., Daegu, Rep. of Korea

[21] Appl. No.: 09/076,130

[22] Filed: May 12, 1998

[30] Foreign Application Priority Data

Nov. 13, 1997 [KR] Rep. of Korea ..... 97-60645

[51] Int. Cl.[6] ..... D03D 45/50

[52] U.S. Cl. ..... 139/116.2; 139/302

[58] Field of Search ..... 139/116.2, 302

[56] References Cited

U.S. PATENT DOCUMENTS 4,749,006 6/1988 Miyamoto ..... 139/370.2

4,958,662 9/1990 Takegawa ..... 139/116.2

5,009,253 4/1991 Pajgrt et al. ..... 139/116.2

*Primary Examiner*—Andy Falik

[57] ABSTRACT

A weft removal device removes a waste weft using a catch cord yarn without a shed motion. The device includes a spindle having a cling part formed at its one end portion for entangling a thread to a cord, and a bracket supporting the spindle. The device further includes a weft pusher, a weft pusher carrier, and a housing for containing the pusher and the carrier. The housing is positioned on a weft guiding plate having a plurality of reed holes. As the spindle is rotated, the waste weft clings to the cling part of the spindle and is entangled with the catch cord yarn. The entangled weft and yarn is collected in a box.

17 Claims, 4 Drawing Sheets

REMOVAL DEVICE FOR A WASTE WEFT

BACKGROUND OF THE INVENTION

1. Field of the Invention

The present invention relates to a waste weft removal device for removing the waste weft with a catch cord yarn after the weft is cut off in a jet loom, and more particularly, to a thread removal device which uses a catch cord yarn without a shed motion.

2. Discussion of the Related Art

Generally, weaving of a textile in a jet loom in the past has proceeded as follows.

As shown in FIGS. 9 and 10, a weft 100 is thrust by a water injection through the shed of a warp 102. The weft 100 is conventionally thrust about 6–10 cm more than the width of a textile 104. Thus, when the thrust weft 100 is cut by a cutter 108, the waste weft 100 is entangled with a catch cord yarn 110 by the shed motion of catch cord yarn heddles 112. The entangled weft is then twisted by the rotation of a spindle 114 and removed out of the jet loom. Generally, the catch cord yarn 110 is formed with four strips of threads which are moved according to the shed motion of the catch cord yarn heddles 112. The shed motion of the catch cord yarn heddles 112 is transmitted to the catch cord yarn 110.

As described hereinabove, the weft 100 is entangled with the catch cord yarn 110 by the shed motion of the catch cord yarn 110. The entangled weft and yarn 113 is removed out of the jet loom through the spindle 114 and collected in a collecting box.

Such conventional devices, however, still suffer from a number of problems. For example, the four-strip catch cord yarn is moved up and down by the shed motion along with the operation of the jet loom and in the Dobby machine, only the catch cord yarn is to be moved in the shed motion. Such causes much abrasion on the machine and renders the preliminary operation of the machine difficult. Further, to avoid thread cuts, it is necessary to manage the four strips of the catch cord yarn so that tension for each of the strips equals the others. This requires much attention and complicates the device.

Moreover, in the conventional waste weft removal devices, the shed motion of the catch cord yarn interferes with the edge parts of the weft, causing difficulty in normal weaving operations.

SUMMARY OF THE INVENTION

It is an object of the present invention to provide a weft removal device which uses a catch cord yarn without the shed motion, to effectively remove a waste weft during the weaving process.

It is another object of the present invention to provide a waste weft removal device which overcomes the problems and disadvantages encountered in the conventional waste weft removal devices.

It is another object of the present invention to provide a spindle device having a bracket, a spindle having a cling part supported by the bracket, and a hook with a hooking sill positioned on one side of the spindle, for ensuring complete entanglement of the waste weft to the catch cord yarn. The spindle device further includes a cling preventive plate for preventing the uncut weft from clinging to the cling part of the spindle and for avoiding premature entangling of the weft with the catch cord yarn.

It is another object of the present invention to provide a waste weft remover including a weft pusher contained in a housing disposed on one side of a weft guiding plate, for properly guiding the waste weft to cling to a spindle.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed descriptions.

Briefly described, the present invention is directed to a device for removing a thread, including a reed, comprising a spindle having a cling part formed at its one end portion for entangling a thread to a guiding cord; and a bracket supporting the spindle.

BRIEF DESCRIPTION OF THE DRAWINGS

The present invention will become more fully understood from the detailed description given hereinbelow and the accompanying drawings which are given by way of illustration only, and thus are not limitative of the present invention, wherein:

FIG. 3 is a side view of the waste weft removal device according to the present invention;

FIG. 4 is a perspective view of a spindle installed in the waste weft removal device;

FIG. 5 is a side view of the waste weft removal device with a two-strip catch cord yarn according to another embodiment of the present invention;

DETAILED DESCRIPTION OF THE PREFERRED EMBODIMENTS

Figure 1:
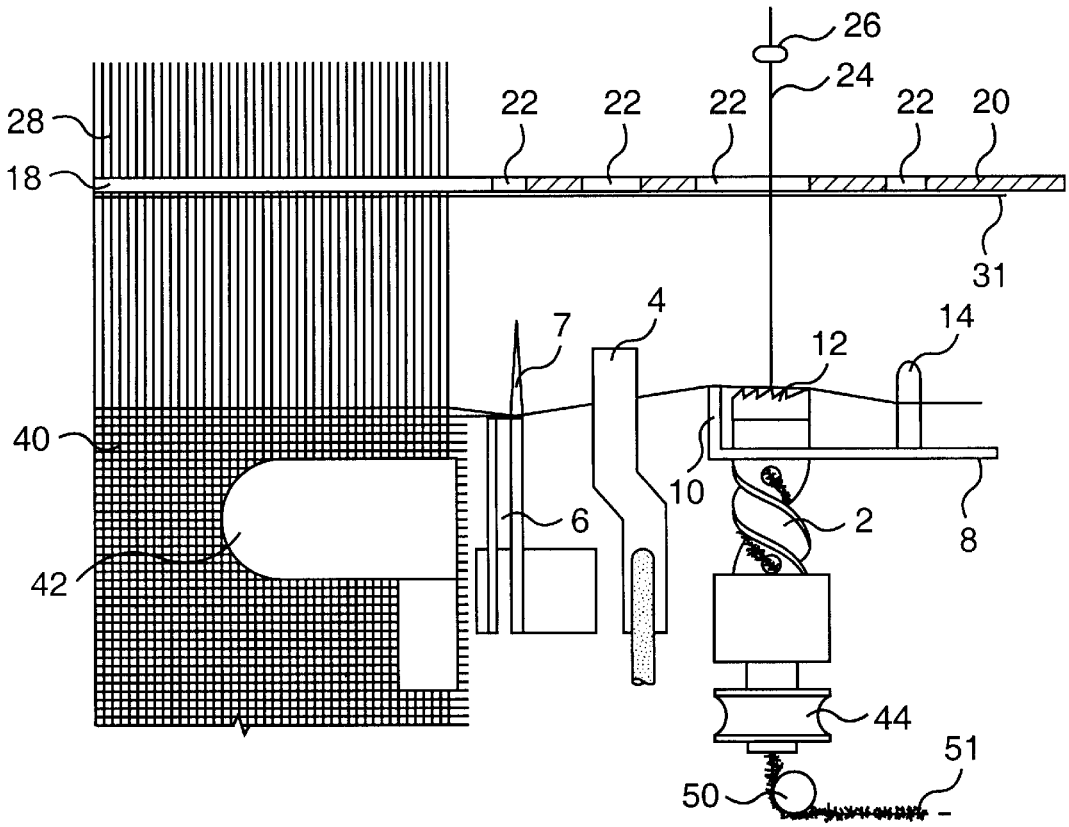
FIG. 1 is a plan view of a weaving apparatus with a waste weft removal device according to the embodiments of the present invention.
Figure 2:
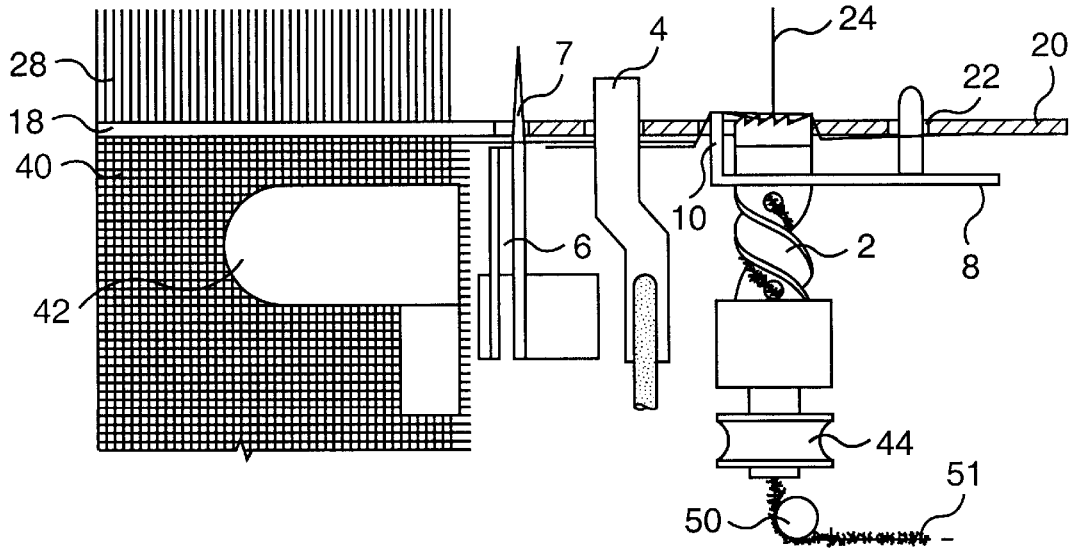
FIG. 2 is a plan view of the weaving apparatus in which a reed is advanced for heating up.

FIGS. 1 and 2 show operational views of a weaving apparatus with a waste weft removal device according to the embodiments of the present invention.

As shown in FIGS. 1 and 2, the apparatus for weaving a textile 40 includes a weft sensor 4, a first hook 7, and a cutter 6 installed at one side of a jet loom. A bracket 8, a rotatable spindle 2, and a second hook 14 are positioned on one side of the weft sensor 4. A movable reed 18 for moving a weft 31 is located in front of the spindle 2, and a weft guiding plate 20 having a plurality of reed holes 22 is positioned with the reed 18. The weft guiding plate 20 moves with the reed 18 according to the reed's forward and backward motion. The first hook 7, the weft sensor 4, the spindle 2 and the second hook 14 pass through the corresponding reed holes 22 when the weft guiding plate 20 is advanced with the reed 18, as shown in FIG. 2. Therefore, the reed holes 22 in the weft guiding plate 20 enhance the forward and backward motion of the reed 18 without interruptions.

Figure 8:
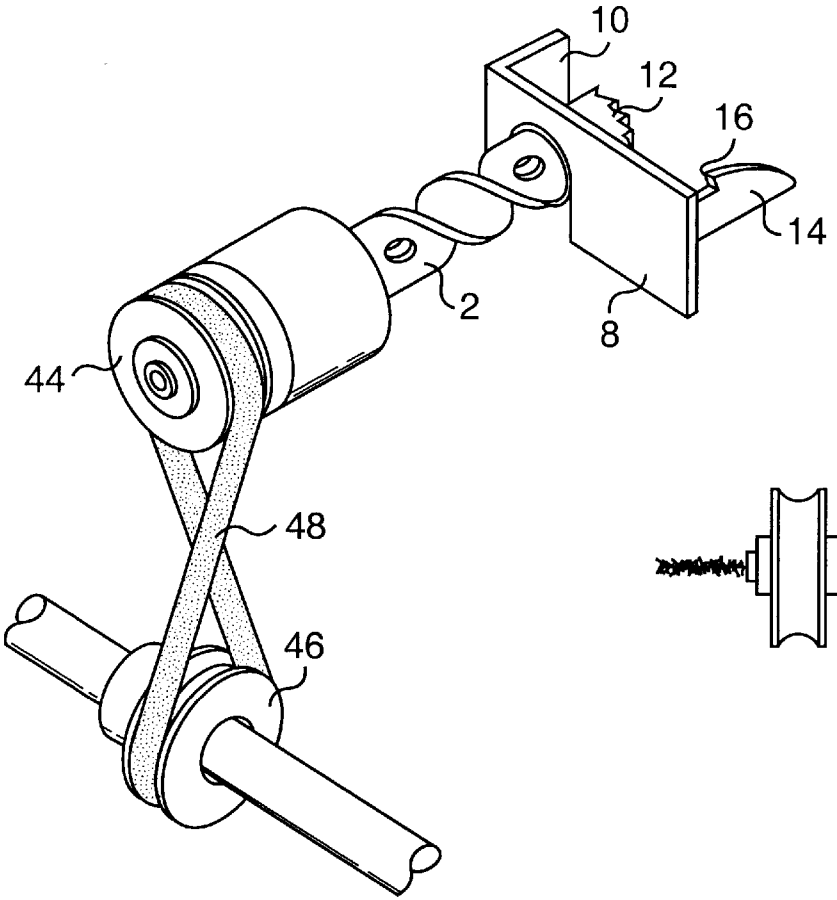
FIG. 8 is a plan view of a rotatable spindle of the waste weft removal device.
Figure 10:
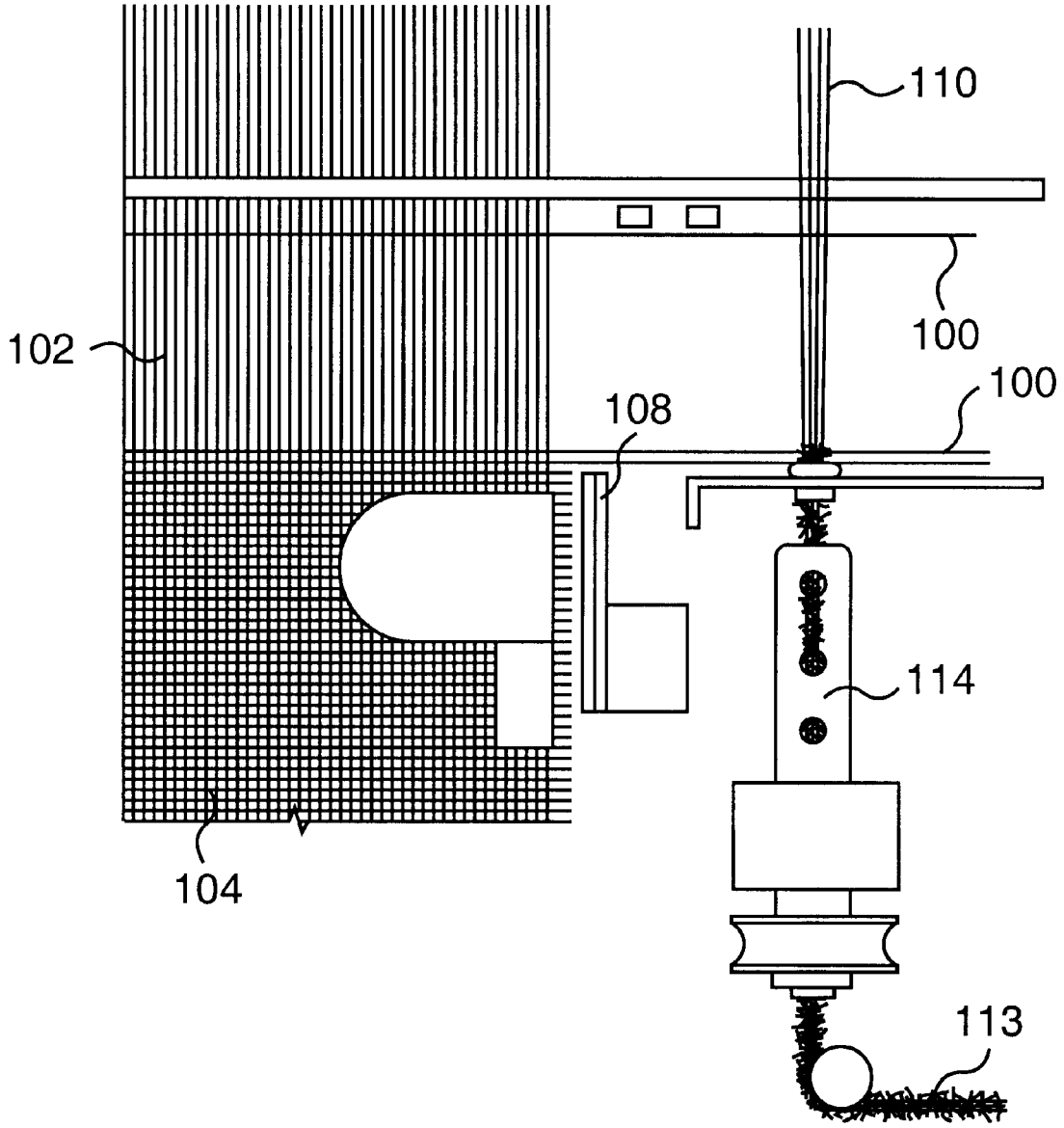
FIG. 10 CONVENTIONAL ART
FIG. 10 is a plan view of the conventional waste weft removal device.

As shown in FIGS. 4 and 8, a cling preventive plate 10 is installed at one side of the bracket 8, and a cling part 12 is formed at the front portion of the spindle 2 and inside the cling preventive plate 10. The cling part 12 has a depression shape as shown in FIG. 4, but is not limited to what is shown. Other shapes or configurations may be used in the cling part 2. At another end of the spindle 2 as shown in FIG. 4, a pulley 44 is connected to a driving pulley 46 by a belt, so that the rotation of the driving pulley 46 causes rotation of the spindle 2. On the bracket 8, the hook 14 which has a hooking sill 16 is formed adjacent the cling part 12 of the spindle 2. The cling preventive plate 10 is located at one side of the spindle 2 and the hook 14 is located at the other side of the spindle 2 to ensure that the weft 31 is properly entangled with a catch cord yarn 24.

The catch cord yarn 24 can be composed of one strip thread, or two strips of thread, as shown in FIGS. 3 and 5. The effect of having a one-strip catch cord yarn is substantially the same as having a two-strip catch cord yarn. It is desirable that the catch cord yarn 24 be located outside of the shed line of the maximum angular aperture of a warp 28, so that the catch cord yarn 24 does riot interfere with the weft 31 when the weft 31 is thrusted.

When the weft 31 is cut by the cutter 6, the cling part 12 of the spindle 2 and the cling preventive plate 10 are inserted through corresponding reed holes 22 of the weft guiding plate 20. This allows the weft 31 to be entangled to the catch cord yarn 24 without disruption, so that an entangled weft and yarn 51 is guided by a guiding roller 50 and collected in a collection box.

Figure 6:
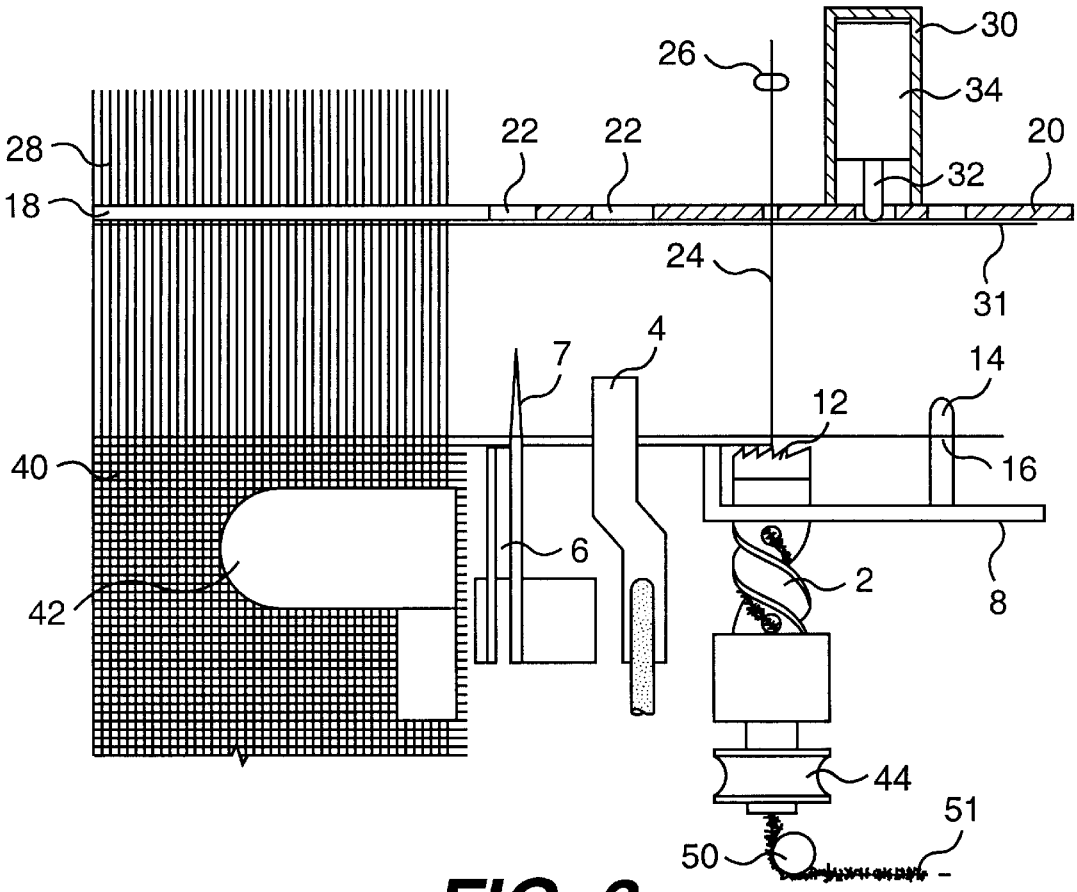
FIGS. 6 and 7 are views showing an operation of the weaving apparatus with a waste weft removal device including a weft pusher according to another embodiment of the present invention.
Figure 7:
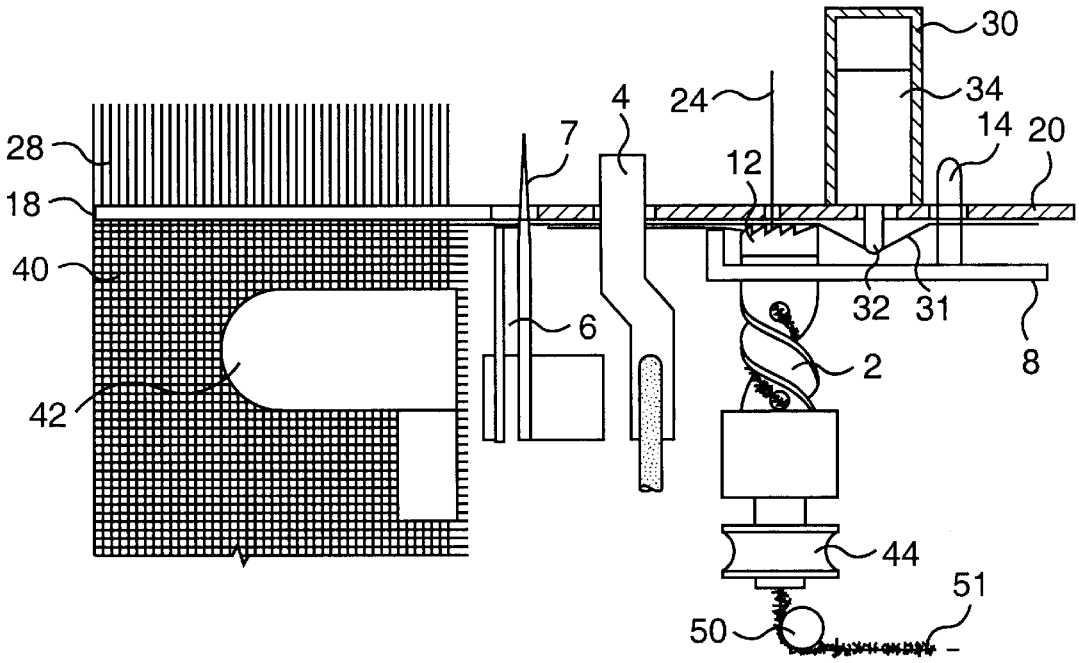
Figure 9:
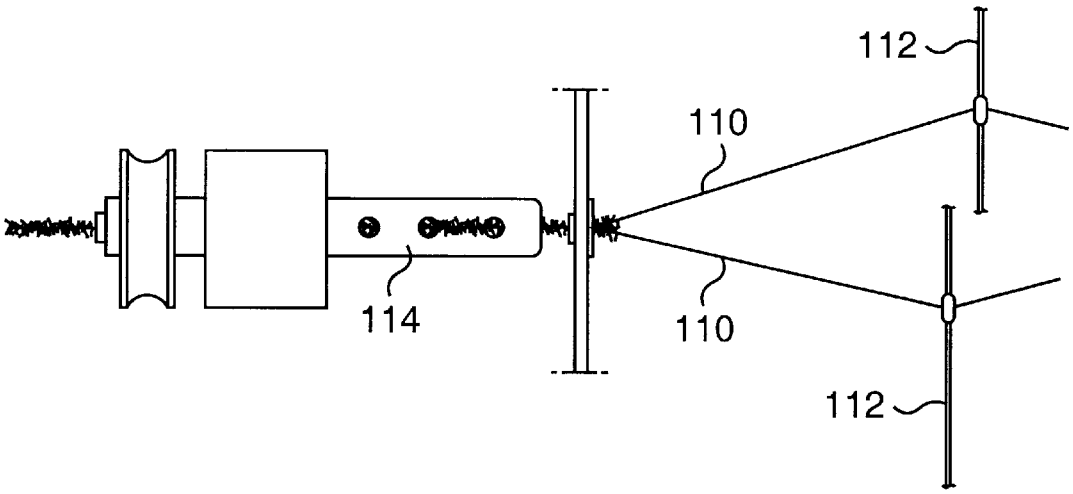
FIG. 9 CONVENTIONAL ART
FIG. 9 is a side view of a conventional waste weft removal device.

According to another embodiment of the present invention as shown in FIGS. 6 and 7, the weaving apparatus having the removal device further includes a weft pusher housing 30 fixed on the backside of the weft guiding plate 20. The weft pusher housing 30 contains a weft pusher carrier 34 and a weft pusher 32. By the forward and backward movement of the reed 18, the weft pusher 32 also moves in and out of the reed hole 20 of the weft guiding plate 20 to push the weft toward the bracket 8. This causes the weft 31 to cling to the cling part 12 of the spindle 2 more effectively.

The cling part 12 of the spindle 2 does not touch the front side of the weft guiding plate 20 when the reed 18 moves toward the spindle 2. The weft 31 clings to the cling part 12 of the spindle 2 as the weft pusher carrier 34 moves forward and pushes the weft 31 toward the spindle 2, as shown in FIG. 7. As the spindle 2 is rotated, the weft 31 clinging to the part 12 is entangled with the catch cord yarn 24 and removed as the entangled weft and yarn 51, similar to the conventional jet loom.

The present invention differs from the conventional jet loom in that the waste weft is removed without the shed motion of the catch cord yarn 24. That is, in the present invention, the driving pulley 46 and the pulley 44 (FIG. 8) are rotated to rotate the spindle 2 during the weaving of the textile 40 having a temple 42. In this situation, if the weft 31 is thrust as shown in FIG. 1, the weft guiding plate 20 moves toward the spindle 2 together with the advancing reed 18, and the thrust weft 31 moves forward with them. Then, as shown in FIGS. 2 and 7, the edge of the weft 31 begins to cling to the cling part 12 as the catch cord yarn 24 is rotated with the spindle 2.

The waste weft 31 rotating with the spindle 2 is entangled to the outer surfaces of the catch cord yarn 24. The edge of the weft 31 which is thrust for more than the width of the textile 40 is cut by the cutter 6, entangled with the catch cord yarn and removed out of the jet loom for collection.

The second hook 14 installed on the side of the spindle 2 hangs the weft 31 guided by the weft guiding plate 20 on the hooking sill 16. By doing so, when the reed 18 moves away from the spindle 2, the weft 31 advanced by the weft guiding plate 20 is easily separated from the weft guiding plate 20 and placed on the hooking sill 16. At the same time, the weft 31 clings to the cling part 12 of the spindle 2 more easily. The cling preventive plate 10 of the bracket 8 prevents flaws in the textile 40 due to the unexpected pulling of the weft 31 waiting to be cut (also known as "the weft in waiting").

As shown in FIG. 3, the catch cord yarn 24 does not generate shed motion since it is directly connected with the spindle 2 after being guided by a yarn guide 26. By placing the yarn guide 26 lower than the location of the maximum shed of the warp 28, the weft 31 is smoothly thrusted without any interruption or interference.

In the present invention, it is possible to combine and form the weft pusher housing 30 on the backside of the weft guiding plate 20, and to install the weft pusher carrier 34 in the housing 20 to move the weft pusher 32 forward and backward. As shown in FIG. 6, if the weft guiding plate 20 moves forward with the reed 18 under the situation where the weft 31 has been completely inserted into the space between the warp 28, the weft 31 also advances with them.

When the reed 18 arrives to the foremost front, as shown in FIG. 7, the weft pusher carrier 34 moves down by the force of inertia from the beating motion, and pushes the weft 31 toward the bracket 8. Accordingly, a part of the weft 31 clings to the cling part 12 of the spindle 2, and the waste weft 31 rotates with the cling part 12 of the spindle 2 and is entangled with the outer surfaces of the catch cord yarn 24. The entangled weft and yarn 51 is output and collected in a collection box.

Thereafter, the reed 18 moves away from the spindle 2. When the reed 18 moves to the foremost back line, the weft pusher carrier 34 also moves backward by the force of inertia. The weft pusher 32 which was protruded toward the weft guiding plate 20 is then moved backward and completely contained inside of the weft pusher housing 30. As a result, there is no interruption to the weft 31 being thrust between the warp 28, and weaving of the textile 40 continues flawlessly.

The present invention removes the waste weft which was thrust over the right edge of textile while weaving in a jet loom, without the use of a shed motion of the catch cord yarn. Therefore, the structure of the device is simplified and minimizes abrasion to the machine. Further, the present invention facilitates the management of the catch cord yarn, increases the efficiency of a weaving process, elevates productivity, and prevents unexpected situations where the weft (being thrusted while weaving) may stop the operation of the jet loom by the interruption of the catch cord yarn.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for removing a thread, including a reed, comprising:

a spindle having a cling part formed at its one end portion for entangling a thread to a core, a bracket supporting the spindle, and a weft guiding plate formed on the reed and having a plurality of holes.

2. The device as claimed in claim 1, wherein the cling part has a depression configuration.

3. The device as claimed in claim 1, further comprising:

a weft pusher;

a weft pusher carrier formed on the weft guiding plate; and a weft pusher housing containing the weft pusher and weft pusher carrier.

4. The device as claimed in claim 3, wherein the cling part of the spindle is inserted through one of the holes of the weft guiding plate.

5. The device as claimed in claim 1, wherein the bracket includes a cling preventive plate formed at one side thereof.

6. The device as claimed in claim 1, wherein the bracket has substantially an L-configuration.

7. The device as claimed in claim 1, further comprising:

a hook formed on the bracket and having a hook sill.

8. The device as claimed in claim 7, wherein the hook is inserted through one of the holes of the weft guiding plate.

9. The device as claimed in claim 8, wherein as the hook is inserted through the one hole of the weft guiding plate, the cling part of the spindle is inserted through another hole of the weft guiding plate.

10. The device as claimed in claim 1, further comprising:

pushing means for pushing the thread toward the bracket so as to cling the thread to the cling part of the spindle.

11. The device as claimed in claim 10, wherein the pushing means includes a weft pusher which is moved by inertia.

12. A weaving device, comprising:

means for weaving a textile using a weft;

a spindle for entangling a portion of the weft to a yarn, said spindle including a depression configuration formed at its one end to which the portion of the weft clings, supporting means for the spindle, pushing means for another portion of inertia; and a weft guiding plate coupled to a read and having a plurality of holes, the yarn moving through one of said holes.

13. The device as claimed in claim 12, wherein the supporting means includes a bracket, and the pushing means includes a weft pusher moving through another one of the holes of the weft guiding plate.

14. A device for removing a thread, including a reed, comprising:

a spindle having a cling part formed at its one end portion for entangling a thread to a cord, said spindle including a twisted portion and a plurality of spindle holes, and a bracket supporting the spindle.

15. The device as claimed in claim 14, further comprising:

a fixed cord guide for guiding the cord through the reed.

16. The device as claimed in claim 14, wherein the cord is moved toward the spindle, without a shed motion.

17. The device as claimed in claim 14, further comprising:

rotating means for rotating the spindle.

* * * * *